US005847552A

United States Patent [19]

Brown

[11] Patent Number: 5,847,552

[45] Date of Patent: Dec. 8, 1998

[54] INTEGRATED CIRCUIT WITH DETERMINATE POWER SOURCE CONTROL

[75] Inventor: Alan E. Brown, Georgetown, Tex.

[73] Assignee: Dell USA, L.P., Round Rock, Tex.

[21] Appl. No.: 377,579

[22] Filed: Jan. 24, 1995

[51] Int. Cl.[6] ..... G05F 1/46

[52] U.S. Cl. ..... 323/281

[58] Field of Search ..... 323/281, 282, 323/283, 294

[56] References Cited

U.S. PATENT DOCUMENTS

| | | | |
|---|---|---|---|
| 3,723,852 | 3/1973 | Peterson et al. | 323/8 |
| 4,258,310 | 3/1981 | Asakawa et al. | 323/281 |
| 4,298,835 | 11/1981 | Rowe | 323/281 |
| 4,377,781 | 3/1983 | Tatsushi et al. | 323/299 |
| 4,441,826 | 4/1984 | Morokawa et al. | 368/204 |
| 5,088,018 | 2/1992 | Lee | 363/56 |
| 5,099,196 | 3/1992 | Longwell et al. | 324/158 R |
| 5,355,297 | 10/1994 | Kawabata et al. | 363/43 |
| 5,483,436 | 1/1996 | Brown et al. | 363/98 |

*Primary Examiner*—Peter S. Wong
*Assistant Examiner*—Rajnikant B. Patel
*Attorney, Agent, or Firm*—Skjerven, Morrill, MacPherson, Franklin & Friel; Stephen A. Terrile

[57] ABSTRACT

A determinate power source control for an integrated circuit (10) includes a variable voltage regulator (16), which is operable to receive a supply voltage on the input thereof and output a regulated voltage for input to the integrated circuit (10). A voltage adjustment circuit (22) is operable to generate a voltage adjustment value $V_{ADJ}$ for input to the voltage regulator (16) to determine the voltage output thereby. In a determinate operating mode, the voltage adjustment circuit (22) varies the $V_{ADJ}$ value to cause the regulator (16) to vary the regulated output voltage to the integrated circuit (10). For each value, the operating speed of the integrated circuit (10) is determined and this information stored in a table (24). Thereafter, the voltage adjustment circuit (22) is placed in an operating mode wherein the voltage adjustment value associated with the optimum operating speeds of the integrated circuit (10) is selected and input to the voltage regulator (16). The voltage adjustment circuit (22) utilizes an on-chip ring oscillator (38) to generate a series of pulses which are input to a counter (48). The counter (48) and ring oscillator (38) are operated for a predetermined amount of time with reference to crystal oscillator (30), and then this value latched into latch (52).

20 Claims, 3 Drawing Sheets

INTEGRATED CIRCUIT WITH DETERMINATE POWER SOURCE CONTROL

TECHNICAL FIELD OF THE INVENTION

This application pertains in general to power supplies, and more particularly to a control mechanism for varying the regulated output of a power supply in order to provide an optimum power supply setting for an integrated circuit.

CROSS REFERENCE TO RELATED APPLICATION

This application is related to U.S. Pat. No. 5,099,196, issued Mar. 26, 1992 to Michael L. Longwell, et al.

BACKGROUND OF THE INVENTION

Integrated circuit semiconductor chips are subject to process variations which can affect the operating parameters thereof. Typically, most integrated circuits have a wide enough operating range such that process variations do not effect the yield. However, as integrated circuits become more dense and the complexity of the associated circuitry increases, this can affect the yield, and the resultant cost of the integrated circuit.

Microprocessors are highly complex integrated circuits which operate off of a system power supply voltage. This system power supply voltage is typically regulated to a given level. When the voltages associated with microprocessors were relatively high, on the order of 5 volts or 12 volts, a variation in the regulated power supply voltage could be tolerated with built-in circuitry. This allowed the microprocessor to be relatively immune to power supply fluctuations. Most systems that incorporate microprocessors utilize a 5 volt power supply at present, but the microprocessors themselves have been reduced in voltage to run off of a 3 volt power supply. The motherboard that houses the microprocessor therefore incorporates a built-in voltage regulator that regulates the voltage down from the 5 volt supply level to the 3 volt supply level.

With the lower voltage microprocessors and the increased complexity thereof, process variations have become an important aspect. Since the regulated voltage can vary somewhat due to the tolerances of the regulator and the operating parameters of the microprocessors themselves can vary, it is necessary to ensure that the two are properly mated. One problem that has occurred is with respect to microprocessor batches that have been produced at the manufacturer. Typically, a microprocessor manufacturer will ship a microprocessor with an operating voltage of 3.0 volts nominal. However, the manufacturers have not been able to provide a consistent nominal operating voltage and meet all other operating parameters of the device. As such, when the parts are shipped, they are specified with a different operating supply voltage which is necessary to achieve the required operating parameters. It is then necessary for the board manufacturers to incorporate a slightly different power supply voltage on the output of the onboard regulator. This creates a problem in that a non-standard construction will be required.

One method for accounting for processing variation is that disclosed in U.S. Pat. No. 5,099,196, assigned to the present assignee and issued Mar. 24, 1992. This reference discloses an on-chip integrated circuit speed selection method wherein the various parts can be "binned". This is a technique wherein parts are classified as to their speed. The system utilizes an on-chip ring oscillator and a series of registers which provide a count output value that is a function of the operating speed of all the components. The series of pulses is timed for a fixed period of time and the number of pulses on the output of the ring oscillator are counted by an on-chip counter. This count value is indicative of the speed of operation of the semiconductor chip. However, the speed of operation is merely determined for the purpose of classifying the chips at a given operating voltage. This U.S. Pat. No. 5,099,196 is incorporated herein by reference.

SUMMARY OF THE INVENTION

The present invention disclosed and claimed herein comprises a system for evaluating the operation of an integrated circuit as a function of the IC power supply voltage supplied thereto. A regulation circuit is provided for regulating the IC power supply to a regulated voltage level. An adjustment circuit is then operable to adjust the regulated voltage level output by the regulation circuit in response to receiving a voltage adjust signal. The level of the voltage adjust signal is proportional to the regulated voltage level. An operating parameter device is provided for determining select operating parameters of the integrated circuit. A determinate device generates the voltage adjust signal at different levels and then associates each of the different levels with the corresponding determined operating parameters as determined by the operating parameter device.

In another aspect of the present invention, the processor is utilized for determining the one of the predetermined operating parameters that provides optimum operation of the integrated circuit. This voltage adjust value is then continuously output to the adjustment circuit after generation thereof by the determinate device. The associations for each of the different levels and the corresponding determined operating parameters are stored in a table which can be accessed by the processor.

In yet another aspect of the present invention, the operating parameter device and the determinate device are integral to the integrated circuit. The operating parameter device is comprised of a free running oscillator that has a frequency that varies as a function of the IC power supply voltage. The oscillator outputs pulses which are then input to a counter. The counter is operable to count the pulses over a predetermined period of time. The predetermined period of time is independent of vacations in the IC power supply voltage. The number of counts represents the speed of the integrated circuit as a function of the IC power supply voltage.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
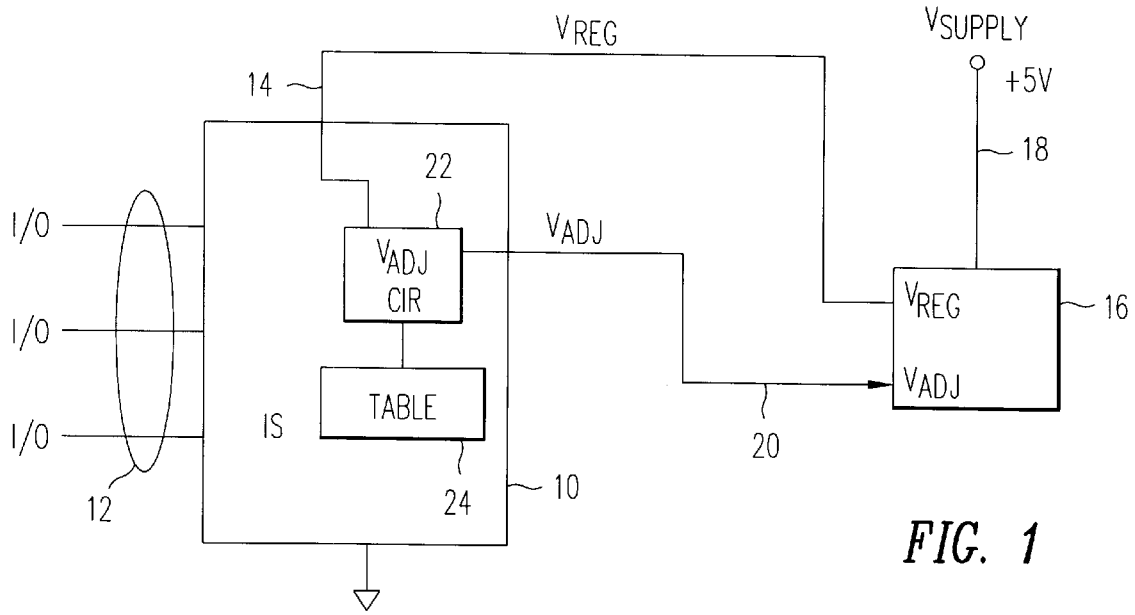
FIG. 1 illustrates an overall block diagram of an integrated circuit implementing the determinate power source control system of the present invention.

Referring now to FIG. 1, there is illustrated an overall block diagram of an integrated circuit 10 utilizing the power source control system of the present invention. The integrated circuit 10 is any kind of integrated circuit such as a microprocessor. This device includes various input/output pins 12 which are utilized for accessing buses, receiving control signals and outputting control signals. The integrated circuit 10 receives on an input 14 a regulated power supply voltage $V_{REG}$. This regulated voltage is generated by a voltage regulator 16. The voltage regulator 16 is operable to receive on an input a supply voltage $V_{SUPPLY}$ on a line 18. In the preferred embodiment, the power supply voltage is +5.0 V with a regulated voltage $V_{REG}$ of between 3.0–3.5 V. This is adjustable through an input $V_{ADJ}$ on a line 20. This is received from a $V_{ADJ}$ output on the integrated circuit 10. This is an analog voltage that will set the value of $V_{REG}$. The integrated circuit 10 includes a voltage adjustment circuit 22 which is operable to generate the $V_{ADJ}$ analog signal at a desired level for input to the voltage regulator 16. The voltage adjustment circuit 22 operates in two modes, a power determinate mode and an operating mode. In the power determinate mode, the voltage adjustment circuit 22 varies the value of $V_{ADJ}$ over a predetermined range. At discrete points in this range, a determination is made as to the overall operation of the integrated circuit 10 in accordance with the predetermined operating scheme. A table 24 is then created which contains the various operating characteristics in association with the value of $V_{ADJ}$. Thereafter, in the operating mode, the voltage adjustment circuit 22 can access the voltage adjustment value that provides the optimum operating performance and outputs this on the line 20. In this manner, the voltage input to the integrated circuit 10 can be determined based upon operating characteristics that are dynamically determined. The voltage adjustment circuit 22 can operate either upon power-up of the part or it can receive an external control signal to cause it to periodically determine the power level. In the preferred embodiment, this is done upon power-up.

Figure 2:
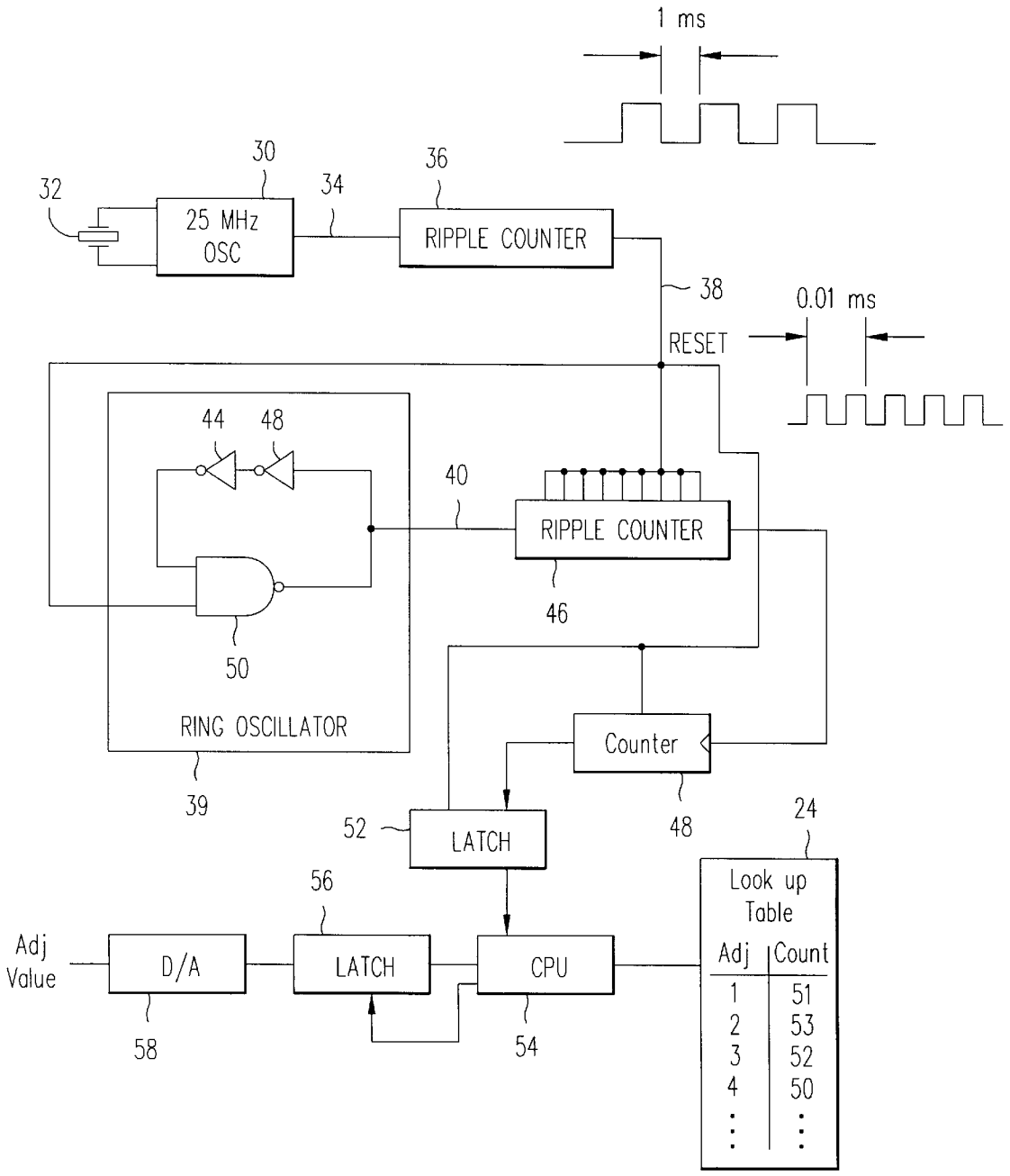
FIG. 2 illustrates a block diagram of the power source control system.

Referring now to FIG. 2, there is illustrated a more detailed block diagram of the voltage adjustment circuit 22. A 25 mHz oscillator 30 is provided which is crystal controlled and utilizes a crystal 32. This outputs a 25 mHz clock signal on a line 34 which is input to the input of a ripple counter 36. The ripple counter 36 is operable to divide the 25 mHz oscillator signal to provide a reset clock on a line 38, which has a time of 1 millisecond between adjacent edges in the clock signal, as illustrated in FIG. 2. Additionally, a ring oscillator 39 is provided which is an oscillator that is operable to generate pulses on an output line 40. This ring oscillator 39 is not referenced to any type of external stable crystal or the such and, therefore, is representative of the speed of the components formed in the chip. By examining the pulse stream output from the ring oscillator 39, the operational speed of the ring oscillator and, therefore, that of the other components formed in the semiconductor chip, can be determined, as will be described in more detail hereinbelow.

The ring oscillator 39 is comprised of two series connected inverters 44, 48 and a NAND gate 50, all connected in series. The NAND gate 50 has one input thereof connected to the output of inverter 44 and the output thereof connected to the input of inverter 48, inverter 48 has the output thereof connected to the input of inverter 44. The other input of the NAND gate 50 is connected to the reset line 38 on the output of the ripple counter 36. As such, whenever the reset signal goes low, the ring oscillator 39 stops oscillating.

The output of the ring oscillator 39 is connected to the input of a ripple counter 46 having N stages to provide an overall counter value of $2^N$. The reset line 38 is connected to each of the stages in the ripple counter 46 to reset it upon the output of ripple counter 36 going high. The output of the ripple counter 46 will therefore be a pulse string. This pulse string is input to the clock input of a binary counter 48, which is also reset by the reset line 38. This counter is operable to count the number of pulses output by the ripple counter 44 for the time that the reset value on the line 38 is high. The number of counts counted by counter 48 is a function of the speed of the ring oscillator 39 and the propagation delay to each of the stages in the counter 48 and, therefore, the count value represents a "gauge" for the speed of the system as a function of the voltage.

If the voltage is varied on a microprocessor, the speed of the on-chip components varies. There is typically an optimum voltage, above which and below which the speed will decrease. Therefore, the highest count value recorded by the counter 48 prior to assertion of the reset signal on line 38 for different input voltages will represent the optimum operating performance. Upon assertion of the reset signal on line 38, the value output by the counter 48 is stored in a latch 52.

In order to determine the proper operating characteristics, a CPU 54 is provided which examines the output of the latch 52 and also has access to the lookup table 24. The CPU 54 is operable to enter into a determinate mode wherein a value for $V_{ADJ}$ is generated, these being discrete values. This value is output in digital form and latched into a latch 56 which is then processed by a digital-to-analog converter 58 for output as the $V_{ADJ}$ value. In the determinate mode, the CPU 54 increments through each of the $V_{ADJ}$ values and, after the count value is output, leaves the count value in the latch 52. This count value is then stored in the table in association with the corresponding $V_{ADJ}$ value. This is represented by count values of 51, 53, 52 and 50 for the $V_{ADJ}$ values of 1, 2, 3 and 4, respectively. This is merely for illustrative purposes. By varying the $V_{ADJ}$ value, the voltage input to the microprocessor can be varied and, subsequently, the speed of the components is varied. Thereafter, the CPU 54 then selects the $V_{ADJ}$ value having the highest count value, i.e., the count value associated with the optimum speed of the IC, and latches this into the latch 56 to then enter into the operating mode.

Figure 3:
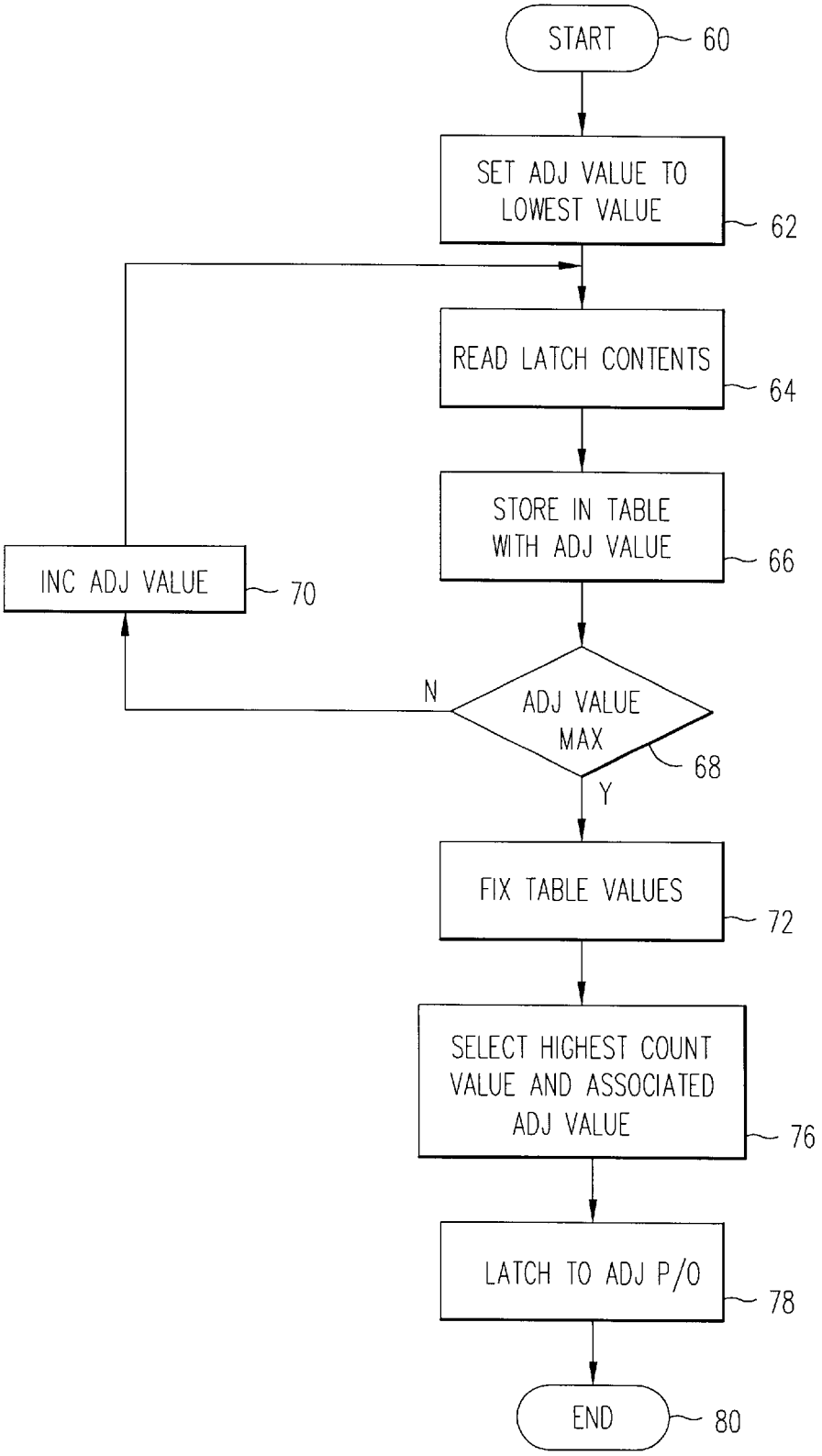
FIG. 3 illustrates a flowchart for the overall operation of determining the optimal operating power level.

Referring now to FIG. 3, there is illustrated a flowchart for the overall operation. The flowchart is initiated at a start block 60 and then proceeds to a function block 62 wherein the $V_{ADJ}$ value is set to its lowest value. Again, this occurs on power-up, although it could occur in response to an internally generated signal or an externally generated signal. It should be understood by those skilled in the art, that if the flowchart is started by an internally generated signal, or an externally generated signal after power up, the program may not set the $V_{ADJ}$ value to a lowest value. Rather, the $V_{ADJ}$ value may be set to an optimum value and would be varied on either side of optimum. The program then flows to a function block 64 in order to read the latch contents from the latch 52. It is important to note that once the $V_{ADJ}$ value is set, the ring oscillator automatically operates. However, the NAND gate 50 could have a separate input for disabling the ring oscillator when not in use.

After the latch contents of latch 52 are read, the program flows to a function block 66 in order to store in the table 24 the $V_{ADJ}$ value in association with its determined count value. The program then flows to a decision block 68 to determine if the $V_{ADJ}$ value is the maximum value. If not, the program flows along the "N" path to a function block 70 in order to increment the $V_{ADJ}$ value. The program then flows back to the input of the function block 64. When the $V_{ADJ}$ value reaches a maximum value, the program will flow from the decision block 68 along a "Y" path to a function block 72 to "fix" the table values. This, in essence, sets these as determined values. The program then flows to a function block 76 to select the highest count values as associated with the $V_{ADJ}$ values and then to a function block 78 to lock this selected value for $V_{ADJ}$ into the latch 56. This is then converted with an analog value by the $V_{ADJ}$ converter 58 for output as the $V_{ADJ}$ value. The program then flows to an END block 80.

Figure 4:
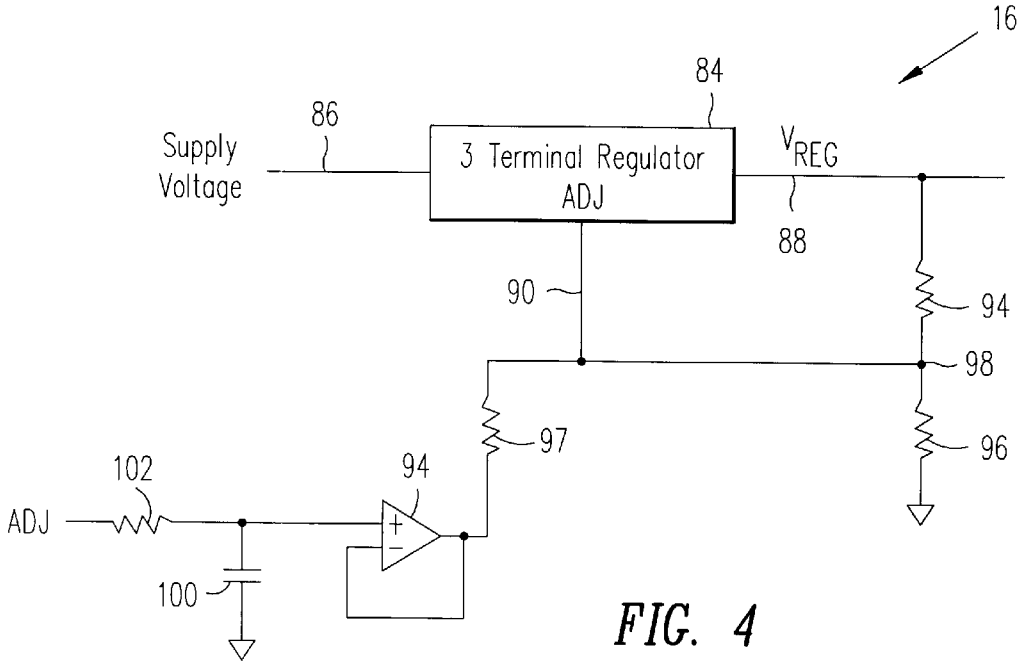
FIG. 4 illustrates a block diagram of the voltage regulator.

Referring now to FIG. 4, there is illustrated a block diagram of the voltage regulator 16 of FIG. 1. The voltage regulator is generally fabricated utilizing a conventional three terminal regulator 84 which has an input supply terminal 86, a voltage regulator output terminal 88 and an adjust input terminal 90. The output terminal 88 is connected to one side of a resistive divider configured with two series-connected resistors 94 and 96, connected together at a common output node 98. The node 98 is connected to the adjacent input 90. A buffer amplifier 94 has the output thereof connected through a resistor 97 to the node 98 and the adjusted input 90. The negative input of buffer amplifier 94 is connected to the output thereof and the positive input thereof is connected to one side of a capacitor 100. The other side of capacitor 100 is connected to ground. The positive input of buffer amplifier 94 is also connected through a series resistor 102 to the $V_{ADJ}$ input.

Figure 5:
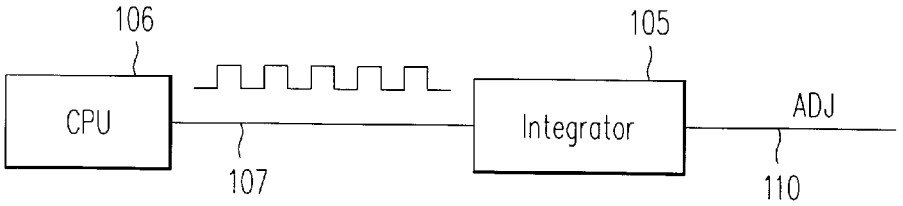
FIG. 5 illustrates an alternate embodiment for the source control of the present invention.

Referring now to FIG. 5, there is illustrated an alternate embodiment of the present invention. In the alternate embodiment, a CPU 106 is provided for generating on an output 107 a voltage adjust signal which is comprised of a series of pulses. The pulses have a pulse width that is varied as a function of operating parameters. Thereafter, it is only necessary to examine the "1's" density of the pulse string and integrate the pulse train with an integrator 108 to provide the $V_{ADJ}$ value on an output 110. Therefore, the output can be either an analog output or a digital output.

In summary, there has been provided a determinate power source control that is operable to determine the optimum operating power supply voltage by varying the power supply voltage to the integrated circuit and then building a table of values representing the operating parameters as a function of the voltage values as the voltage is varied. Thereafter, an output control is generated to control the voltage regulator to operate at a regulated voltage value associated with the determined optimum value.

Although the preferred embodiment has been described in detail, it should be understood that various changes, substitutions and alterations can be made therein without departing from the spirit and scope of the invention as defined by the appended claims. For example, in addition to measuring the internal speed of the processor by utilizing the ring oscillator, ripple counter method discussed above, alternative methodologies may be used for testing optimum operating voltages of processors. This should include data pattern test, algorithm simulations, etc., wherein a series of tests are executed on a processor, and the voltage is altered for each test, the results of which provide information regarding the optimum operating voltage for the processor. This information is then provided to a voltage regulator to provide an optimum operating voltage.

What is claimed is:

1. A system for evaluating the operation of an integrated circuit (IC) as a function of the IC power supply voltage supplied thereto, comprising:

a regulation circuit for regulating the IC power supply voltage to a regulated voltage;

an adjustment circuit for adjusting the regulated voltage level output by said regulation circuit in response to receiving a voltage adjust signal, said regulated voltage level corresponding to the value of said voltage adjust signal;

an operating parameter device for determining select operating parameters of the integrated circuit; and a determinate device for generating said voltage adjust signal at different values and associating each of said different values with the corresponding determined operating parameters as determined by said operating parameter device.

2. The system of claim 1, and further comprising a processor for determining the one of said determined operating parameters that provides optimum operation of the integrated circuit and then controlling said determinate device to continuously generate the one of said different values of said voltage adjust signal to said adjustment circuit.

3. The system of claim 1, wherein the integrated circuit operates at a speed that is a function of the regulated voltage, wherein the select operating parameters that are determined by said operating parameter device are associated with the speed of the integrated circuit.

4. The system of claim 1, and further comprising a table for storing the association determined by said determinate device such that a representation of each of said different values of said voltage adjust signal is stored in said table with said associated determined operating parameters.

5. The system of claim 1, wherein said operating parameter device and said determinate device are integral with the integrated circuit.

6. The system of claim 1, wherein said operating parameter device is operable to determine the speed of the integrated circuit as the selected operating parameters and said operating parameter device includes a free running oscillator for outputting a pulse stream, the frequency of which is a function of the power supply and varies as the IC power supply voltage varies.

7. The system of claim 6, wherein said operating parameter device further includes a counter for counting the output pulses of said free running oscillator for a predetermined period of time, said predetermined period of time independent of variations in the power supply of the IC power supply voltage, said count value of said counter after said predetermined period of time representing said operating parameters.

8. A method for evaluating the operation of an integrated circuit as the function of the IC power supply voltage supplied thereto, comprising the steps of:

regulating the IC power supply voltage to a regulated voltage level;

adjusting the regulated voltage level as determined by the step of regulating in response to receiving a voltage adjust signal, the regulated voltage level a function of the value of the voltage adjust signal;

determining select operating parameters of the integrated circuit that are sensitive to variations of the level of the IC power supply voltage; and generating the voltage adjust signal at different values and associating each of the different values with the corresponding determined operating parameters as determined by the operating parameter device.

9. The method of claim 8, and further comprising, determining the one of the determined operating parameters that provides optimum performance of the integrated circuit and controlling the step of determining to continuously generate and output the one of the different values of the voltage adjust signal with the step of adjusting.

10. The method of claim 8, wherein the integrated circuit operates at a speed that is a function of the regulated voltage level, wherein the select operating parameters are the speed of the integrated circuit.

11. The method of claim 8, and further comprising storing the association determined between each of the different values of the voltage adjust signal and the corresponding determined operating parameters in a table as a representation of each of the different values of the voltage adjust signal and a representation of the associated one of the determined operating parameters.

12. The method of claim 8, wherein the step of determining the select operating parameters comprises:

providing a free running oscillator;

operating the oscillator to provide pulses on the output thereof wherein the oscillator operation is a function of the IC power supply voltage such that the frequency is varied as a function of the IC power supply voltage; and counting the number of pulses over a predetermined period of time to determine the number of counts as a representation of the speed of the integrated circuit, the speed of the integrated circuit being the select operating parameters, the predetermined period of time being independent of variations in the IC power supply voltage level.

13. The system of claim 1, where the integrated circuit is a processor.

14. The method of claim 8, where the integrated circuit is a processor.

15. The system of claim 1, where the voltage adjust signal is an analog signal.

16. The method of claim 8, wherein the voltage adjust signal is an analog signal.

17. The system of claim 2 where the integrated circuit is initially powered up and the one of said determined operating parameters that provides optimum operation is determined when the integrated circuit is powered up.

18. The method of claim 9 wherein the method of determining the one of the determined operating parameters that provides optimum performance of the integrated circuit is performed when the integrated circuit is powered up.

19. The system of claim 2 wherein the integrated circuit operates at a speed that is a function of the regulated voltage; and the one of said determined operating parameters that provides optimum operation of the integrated circuit is associated with a maximum speed of the speeds of the integrated circuit produced from each of the regulated voltages, each of the regulated voltages corresponding to one of said different values of said voltage adjust signal generated by the determinate device.

20. The method of claim 9, wherein the integrated circuit operates at a speed that is a function of the regulated voltage level, wherein the select operating parameters are the speed of the integrated circuit, wherein the one of the determined operating parameters that provides optimum performance of the integrated circuit is a maximum speed of the speeds of the integrated circuit obtained from each of the regulated voltage levels where each of the regulated voltage levels is a function of one of the different values of the voltage adjust signal generated.

* * * * *